United States Patent [19]

Frank

[11] 4,251,042

[45] Feb. 17, 1981

[54] RAILWAY DOUBLE TONGUE SWITCH

[75] Inventor: Earl E. Frank, Tallman, N.Y.

[73] Assignee: Abex Corporation, New York, N.Y.

[21] Appl. No.: 19,012

[22] Filed: Mar. 5, 1979

[51] Int. Cl.[3] ..... E01B 7/04

[52] U.S. Cl. ..... 246/443; 246/442; 246/444

[58] Field of Search ..... 246/380, 385, 392, 415 R, 246/428, 430, 435 R, 436–437, 442–444, 454, 458, 467, 468; 104/130, 195, 279

[56] References Cited

U.S. PATENT DOCUMENTS

| | | | |
|---|---|---|---|
| 719,557 | 2/1903 | Blanchard | 246/443 |
| 1,388,700 | 8/1921 | Cwojna | 246/430 |
| 2,231,232 | 2/1941 | Theodos | 246/442 |
| 3,977,635 | 8/1976 | Pirker et al. | 246/392 |
| 4,059,054 | 11/1977 | Alimanestianu et al. | 104/130 X |

FOREIGN PATENT DOCUMENTS

| | | | |
|---|---|---|---|
| 357175 | 12/1905 | France | 246/385 |

*Primary Examiner*—Trygve M. Blix
*Assistant Examiner*—Reinhard J. Eisenzopf
*Attorney, Agent, or Firm*—David A. Greenlee; Thomas S. Baker, Jr.

[57] ABSTRACT

A double tongue switch comprises a pair of identical and interchangeable switch assemblies, each of which has a rectangular body with vertical outer walls. Each switch tongue includes a pair of full-width railheads of increased thickness. Each body includes a continuous central support wall beneath the traffic-carrying tongue railhead. The inner end and side walls are ramped to facilitate removal of debris. The tongues are positively locked in extreme positions and are mounted on the bodies by an improved attachment device.

21 Claims, 13 Drawing Figures

RAILWAY DOUBLE TONGUE SWITCH

This invention relates generally to railway tongue switches and more particularly to double tongue switches used in pavement.

Double tongue switches have been developed for use in pavement, such as in the floor of a steel mill or other heavy industrial installation. These switches are used for low speed and heavy load conditions, such as movement of cars in steel mills. These switches must perform in extremely adverse conditions. Debris accumulates in the tongue body and can prevent the complete throwing of the tongue from one position to another. The constant pounding of the tongues by heavily laden cars cause an upward curling of the tongue at the point end. These conditions can cause the derailment of cars. In a steel mill this causes spilling of molten steel which is not only expensive, but can also destroy the switch, requiring replacement.

The conventional type of double tongue switch is shown in AREA (American Railway Engineering Association) Plan No. 987-60. This switch comprises a right- and left-hand switch assemblies interconnected by a throwing mechanism. Each tongue has a single railhead that tapers from full railhead width at the heel to a narrow point and typically has a height or thickness of $2\frac{7}{8}$ inches. The tongue bodies are irregularly shaped and require an odd shaped pavement cavity. Replacement of a switch body is a tedious task, since the switch supporting and fill structure is brickwork which must be removed and replaced. Since the switch assemblies are dissimilar, separate castings must be made and separate parts stocked for right- and left-hand assemblies.

It is an object of this invention to provide a new type of double tongue switch in which both assemblies are identical and interchangeable, the switch bodies and tongues are easily replaceable, and which is so constructed to greatly reduce the possibility of derailment.

In accordance with this invention, a double tongue switch features a pair of identical double tongue switch assemblies having generally rectangular switch bodies with vertical outer walls which are easily inserted into and removed from a pavement recess. The bodies have easily removable tongues, provisions for easily removing debris from the tongue floor and means to positively lock the tongues in the extreme switching positions. The railhead interfaces are bevelled to provide for slight tongue misalignment. Each tongue has a pair of spaced, full width railheads throughout the length of the tongue and a much thicker tongue to prevent curling of the tongue at the point end. The switch bodies have integral, continuous ground-engaging supports for the tongue railheads.

These and further features and advantages of this invention are more fully explained in the following detailed description of a preferred embodiment of this invention shown in the accompanying drawings wherein:

DESCRIPTION OF THE PREFERRED EMBODIMENT

Figure 1:
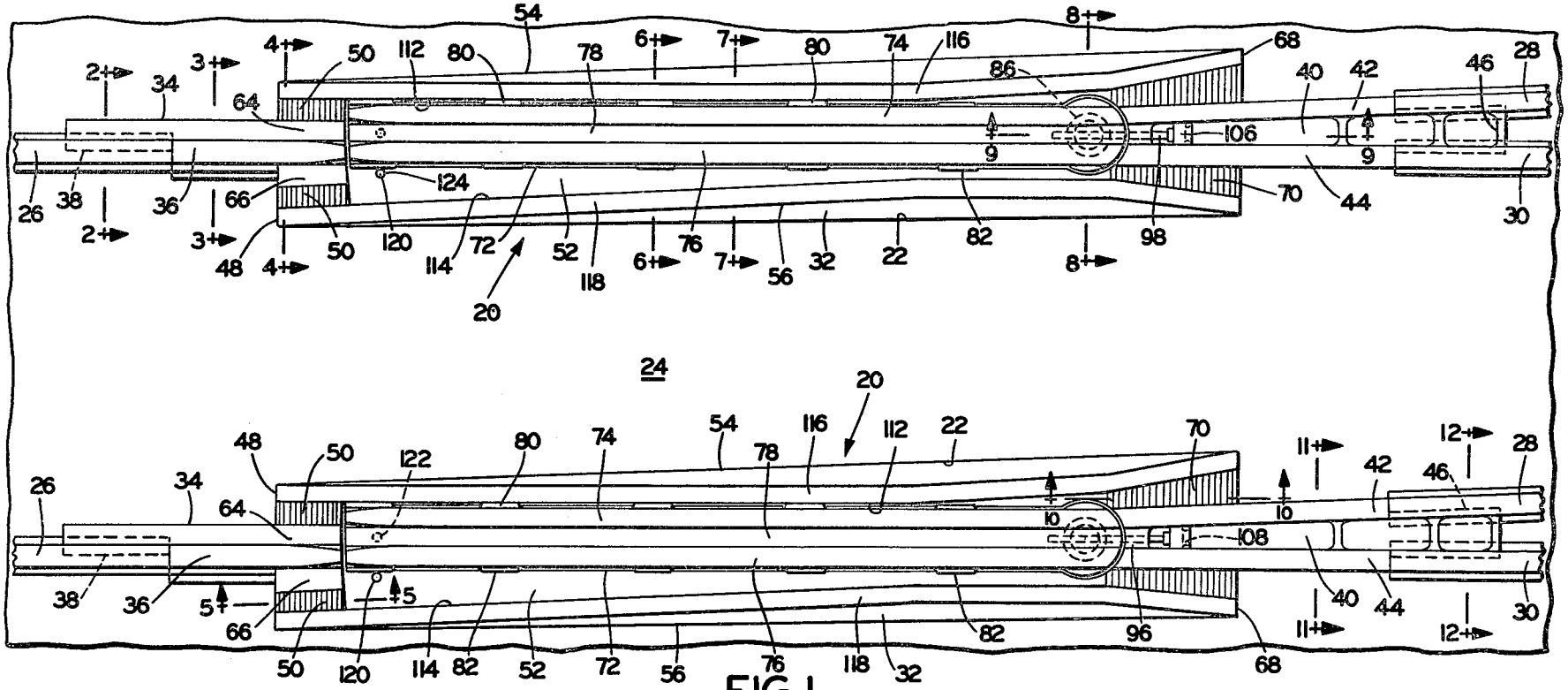
FIG. 1 is a plan view of a double tongue switch according to this invention showing the tongues in one extreme position.

Referring now to FIG. 1 of the drawings, the double tongue switch of this invention comprises a pair of identical switch assemblies 20 which are shown inserted in generally rectangular recesses 22 in a section of pavement 24 which may be the floor of a steel mill or other industrial installation where low speeds and heavy loads are experienced. The switch assemblies 20 are interchangeable and are identical in every respect and each connect to a rail section 26 at the point end and to a pair of rail sections 28 and 30 at the heel end.

Figure 3:
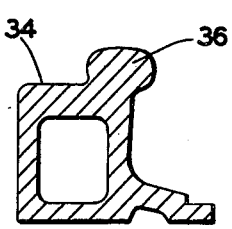
FIG. 3 is an enlarged sectional view taken along line 3—3 of FIG. 1.
Figure 2:
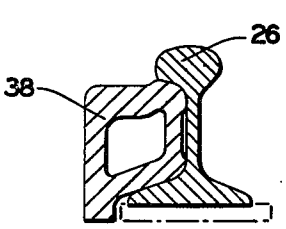
FIG. 2 is an enlarged sectional view taken along line 2—2 of FIG. 1.

Each switch assembly 20 includes a cast manganese steel switch body 32 which is generally rectangular in shape and is inserted into the mating pavement recess 22. Projecting from the point end of body 32 is an integral cast arm 34 which includes an integral railhead 36, as best seen in FIG. 3. As shown in FIG. 2, a point end extension, or easer section, 38 extends from arm 34 and is so formed to support the rail section 26 in alignment with railhead 36.

Figures 5, 6, 7, 8, 9, 10, 11, 12:
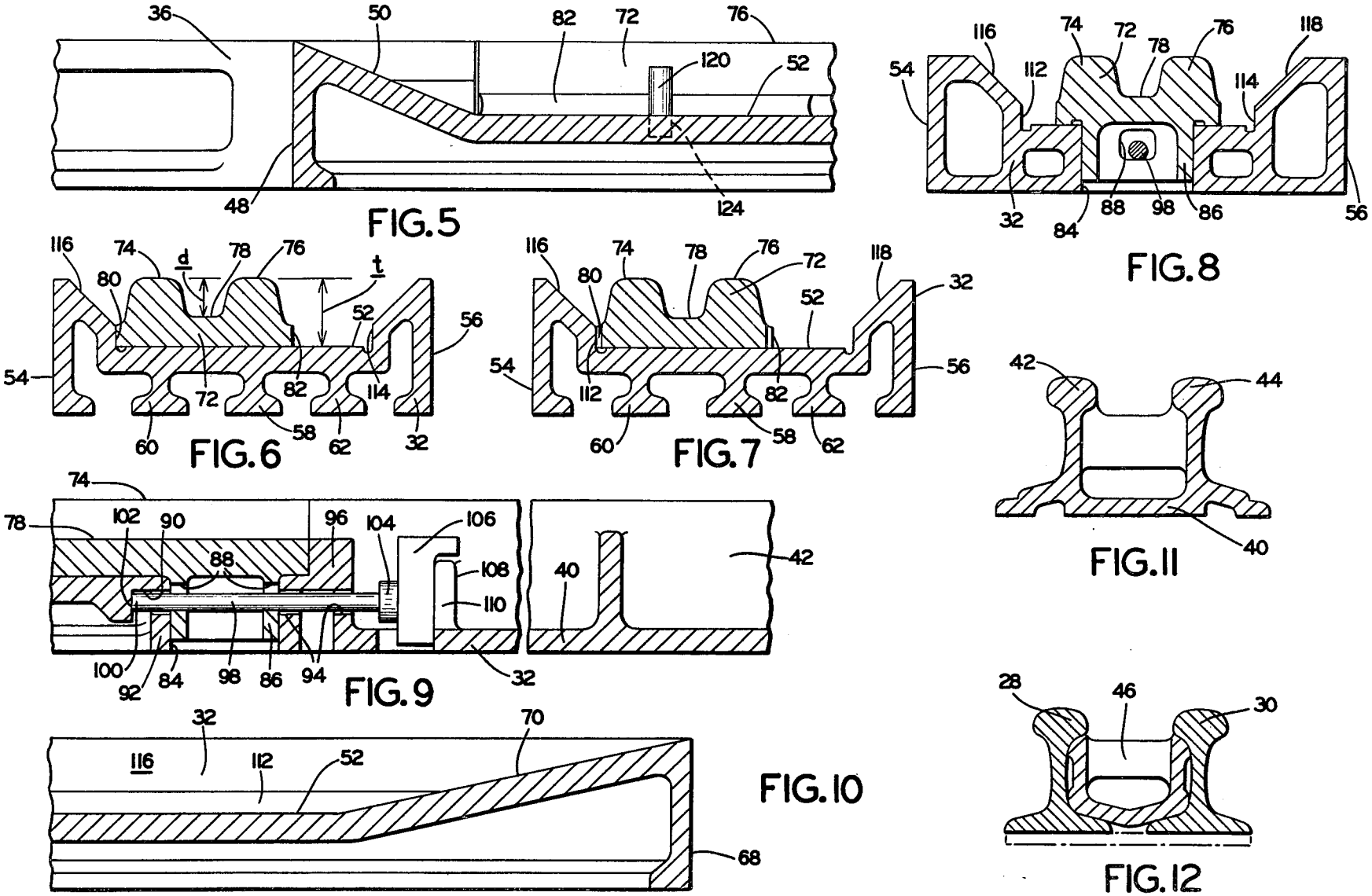
FIG. 5 is an enlarged partial sectional view taken along line 5—5 of FIG. 1.
FIG. 6 is an enlarged sectional view taken along line 6—6 of FIG. 1.
FIG. 7 is an enlarged sectional view taken along line 7—7 of FIG. 1.
FIG. 8 is an enlarged sectional view taken along line 8—8 of FIG. 1.
FIG. 9 is an enlarged sectional view taken along line 9—9 of FIG. 1.
FIG. 10 is an enlarged partial sectional view taken along line 10—10 of FIG. 1.
FIG. 11 is an enlarged sectional view taken along line 11—11 of FIG. 1.
FIG. 12 is an enlarged sectional view taken along line 12—12 of FIG. 1.

Referring to FIGS. 1 and 11, an integral heel end extension 40 extends from the heel end of body 32 and includes a pair of diverging integral railheads 42 and 44. Extension 40 continues in the form of a heel extension rail support 46, shown in FIG. 12, which rigidly supports rail sections 28 and 30 in alignment with railheads 42 and 44.

Figure 4:
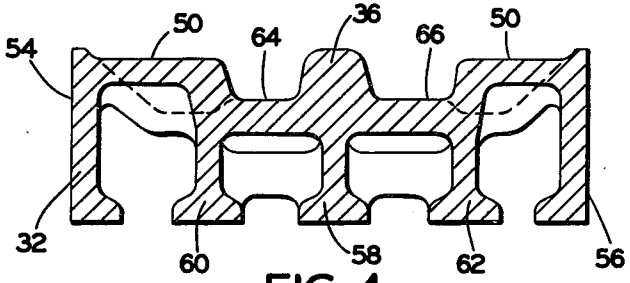
FIG. 4 is an enlarged sectional view taken along line 4—4 of FIG. 1.

Body 32 includes a point end outer end wall 48 which is vertical, as shown in FIG. 5. Ramped or inclined point end inner wall sections 50 extend from the outer end wall 48 and intersect with a flat tongue floor 52. Body 32 also includes vertical outer side walls 54 and 56 which intersect end wall 48, and are shown in FIG. 4. Tongue floor 52 is supported in the pavement by a central supporting wall 58 and flanking supporting walls 60 and 62 which all include integral ground-engaging feet. At the point end, body 32 includes a pair of flangeways 64 and 66 which flank the integral railhead 36 between ramped wall sections 50. Referring now to FIG. 10, body 32 includes a vertical heel outer end wall 68 which intersects heel end inclined or ramped inner wall segments 70 that extend to intersection with tongue floor 52.

The outer periphery of switch body 32 is thus generally rectangular and has vertical end walls 48 and 68 and vertical side walls 54 and 56. This arrangement permits relatively simple installation and removal of each switch assembly into and from the rectangular mating pavement recess 22. No special supporting structure or fill structure need be torn down or constructed to remove or insert either of the switch assemblies into pavement.

Referring again to FIG. 1, each switch assembly 20 comprises a cast manganese steel tongue 72 which includes a pair of integral tongue railhead segments 74 and 76 which are spaced by a tongue flangeway 78 and are full railhead width from the point end to the heel end. As shown in FIG. 6, the tongue has a height or thickness t which is preferably at least $3\frac{3}{4}$ inches and a flangeway depth d which is preferably 2 inches. This provides for a tongue plate or base thickness of $1\frac{3}{4}$ inches. This may be contrasted to conventional prior art tongues which are generally on the order of $2\frac{7}{8}$ inches thick and have a plate thickness of only $\frac{7}{8}$ inch. This extra tongue thickness and full railhead width provide a greater mass which tends to prevent an upward curling at the point end of the tongue caused by repeated passage of very heavy cars, such as loaded cupola cars used in steel mills. Such curling of prior art tongues has been the cause of derailment and the attendant spilling of molten steel or other commodities onto the switch and onto the pavement or other industrial flooring.

Again referring to FIGS. 1, 6 and 7, each tongue 72 is provided at spaced intervals along its edges with stop lugs 80 and 82 whose function will be described later.

A tongue 72 is locked in place by a mechanism best seen in FIGS. 8 and 9. Near the heel end, body 32 is provided with a circular recess 84 which receives a mating cylindrical hub 86 cast integral with tongue 72. Hub 86 is provided with generally rectangular, diametrically opposed, longitudinally aligned slots 88. Adjacent the point end of recess 84 a slot 90 is formed in a supporting web 92 in longitudinal alignment with slots 88. Adjacent the heel end of recess 84, body 32 includes a pair of longitudinally aligned slots 94 formed in a supporting web 96. A bar 98 extends through slots 94, 88 and 90 and has an end 100 which abuts a stop 102 formed in body 32. At its opposite end, bar 98 includes an enlarged head 104 which engages a locking block 106 that is wedged between head 104 and spaced abutments 108 formed integral with body 32.

To remove a tongue 72 from body 32, locking block 106 is pried from between head 104 and abutments 108. Then bar 98 is withdrawn from slots 90, 88 and 94 through an opening 110 between abutments 108 which is slightly wider than bar head 104. With bar 98 removed, tongue hub 86 and tongue 72 may be withdrawn from body recess 84. To install a new tongue, hub 86 is inserted into recess 84 with slots 88 aligned with slots 90 and 94. Bar 98 is then inserted through the slots into abutment with stop 102, whereupon locking block 106 is inserted between head 104 and abutments 108 with a sledge hammer. The circumferential dimension of slots 88 is sufficiently larger than the diameter of bar 98 to permit limited angular movement of tongue 72 on tongue floor 52, as will now be described.

Figure 13:
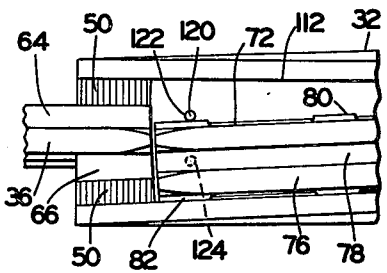
FIG. 13 is a partial plan view of one of the switch assemblies of FIG. 1, showing the tongue in the other extreme position.

As best seen in FIGS. 6, 7 and 8, switch body 32 includes diverging, short, vertical, inner wall segments 112 and 114 which extend upwardly from tongue floor 52. At the top of segments 112 and 114, ramped or inclined inner wall segments 116 and 118 extend upwardly to the top of body 32. As seen in FIGS. 1 and 13, the switch tongue 72 may be moved between one extreme position, in which stop lugs 80 engage side wall 112 to align railheads 76 and 36 (FIG. 1), and another extreme position in which stop lugs 82 engage side wall portions 114 to align railheads 74 and 36 (FIG. 13). The spaced, projecting stop lugs 80 and 82 provide for assured positive engagement of tongue 72 with body 32 in both extreme positions.

In these extreme positions, tongue 72 is held in place by the insertion of a pin 120 into one of the spaced holes 122 or 124 formed in the point end of tongue floor 52. To move tongues 72, pins 120 are removed and the tongues are individually, manually moved (e.g., by pry bar) to the other extreme position. The pins are then replaced to lock the tongues in place. In the extreme positions, the heel ends of railheads 74 or 76 are further in alignment with the integral heel railheads 42 or 44. To diminish the possibility of derailment, the point ends of railheads 74, 76 and 36 are bevelled on either side to permit slight misalignment of the tongue railheads with the body railhead.

It was previously noted that the point end inner wall sections 50, the heel end inner wall sections 70 and the body side wall sections 116 and 118 are all inclined or ramped. This permits the sweeping or ready removal of foreign objects, dirt and debris from the tongue floor 52. In the environment for which this switch was designed, slag and other miscellaneous rubble frequently fall into the switch. It is essential that removal of such debris be simple and expedient, since such debris could prevent alignment of the tongue railheads 74 and 76 with the point end railhead 36 and with the heel end railheads 42 and 44.

It can be seen in FIGS. 4, 6 and 7 that central supporting wall 58 provides continuous direct support for whichever of tongue railheads 74 or 76 carries traffic. This reduces deflection and consequent fatiguing of floor portion 52 of cast switch body 32.

Thus, several features of the double tongue switch according to this invention provide many advantages over the conventional type of double tongue switch shown in AREA Plan No. 987-60. The provision of positive locking pin 120, the bevelling of the mating ends of rail segments 36, 74 and 76, the full width of these railheads, the excessive thickness of tongue 72, and the provision of the inclined ramps 50 and 70 all combine to reduce the possibility of derailment. In addition, there is no interconnection between the two switch assemblies 20, since each of the tongues 72 is moved independently. Further, the simplified means of mounting the tongue 72 to the base 32 enables quick and easy removal of the tongues if they should become damaged. The generally rectangular configuration and vertical outside walls of switch body 32 enable speedy removal of the switch assemblies from the pavement if replacement is required. Since both switch bodies, tongues and other parts are identical, casting cost and the number of spare parts required are reduced. The central support wall 58 continuously directly supports the load during passage of cars and precludes fatiguing of the tongue floor 52.

While only a preferred embodiment of this invention has been shown and described, it is readily apparent that the various features and advantages of the double tongue switch of this invention can be applied to other types of switches.

I claim:

1. A railway tongue switch including a pair of discrete switch assemblies each comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the switch bodies being identical and interchangeable.

2. The railway tongue switch of claim 1, further characterized by each cast body being of generally rectangular shape and having side walls with generally vertical outer surfaces and end walls with generally vertical outer surfaces to enhance rapid insertion into and removal from a mating pavement recess.

3. The railway tongue switch of claim 2, wherein each switch assembly is further characterized by the end walls extending above the tongue floor and having inner wall surfaces inclined longitudinally of the body to facilitate removal of foreign materials from the floor.

4. The railway tongue switch of claim 2, wherein each switch assembly is further characterized by the side walls having inner surfaces and the switch tongue including spaced stop lugs extending laterally of the railheads, the lugs being engageable with the side wall inner surfaces to locate the tongue in the extreme positions.

5. The railway tongue switch of claim 4, wherein each switch assembly is further characterized by locking means located near the point end of the body to lock the tongue in the extreme positions.

6. The railway tongue switch of claim 2, wherein each switch assembly is further characterized by the end walls extending above the tongue floor and having inner wall surfaces inclined longitudinally of the body to facilitate removal of foreign materials from the floor.

7. The railway tongue switch of claim 6, wherein each switch assembly is further characterized by the side walls extending above the tongue floor and having inner wall surfaces inclined laterally of the body.

8. The railway tongue switch of claim 7, wherein each switch assembly is further characterized by the side walls including short vertical inner wall portions extending from the tongue floor to the inclined inner wall surfaces and the switch tongue including spaced stop lugs projecting laterally of the railheads, the lugs being engageable with the short vertical inner wall portions to locate the tongue in the extreme positions.

9. The railway tongue switch of claim 1, wherein each switch assembly is further characterized by the point ends of the tongue railheads and the mating ends of the first rail segments being bevelled on both sides to accommodate slight misalignment in both extreme positions of the tongues.

10. The railway tongue switch of claim 1, wherein each switch assembly is further characterized by the means pivotally mounting the tongue on the tongue floor comprising a circular recess in the floor extending into the body near the heel end, a circular hub extending downwardly from the tongue into the recess, diametrically opposed slots in the hub, mating slots in the body, a bar extending through the slots, and means removably mounting both ends of the bar in the body, the size of the hub slots relative to the bar being sufficient to permit limited rotation of the tongue between extreme positions while preventing vertical displacement of the tongue.

11. The railway tongue switch of claim 10, wherein each switch assembly is further characterized by the slots being oriented longitudinally of the switch assembly.

12. The railway tongue switch of claim 11, wherein each switch assembly is further characterized by a body-mounted stop adjacent one of the body slots engageable by one end of the bar, a body abutment longitudinally spaced from the other end of the bar and having an opening through which the bar can pass, and a locking block interposed between the bar other end and said abutment to lock the bar in the slots, the block being removable to permit the bar to be slid through the opening for removal from the slots to enable removal of the hub from the recess and consequent separation of the tongue from the body.

13. The railway tongue switch of claim 1, wherein each switch assembly is further characterized by the thickness of the railheads being at least $3\frac{3}{4}$ inches.

14. The railway tongue switch of claim 1, wherein each switch assembly is further characterized by the body including a central vertical ground-engaging support located beneath the tongue floor extending longitudinally from the point end to the tongue pivot to directly support the first rail segment and the traffic-carrying railheads in each extreme position of the tongue.

15. A railway tongue switch assembly for use in pavement comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the body having spaced side walls with generally vertical outer surfaces and point-end and heel-end walls having generally vertical outer surfaces to enhance rapid insertion into and removal from a mating pavement recess.

16. A railway tongue switch assembly for use in pavement comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the body having side walls and end walls, the end walls extending above the tongue floor and having inner wall surfaces inclined longitudinally of the body to facilitate removal of foreign materials from the floor.

17. A railway tongue switch assembly for use in pavement comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the point ends of the tongue railheads and the mating end of the first rail segments being bevelled on both sides to accommodate slight misalignment in both extreme positions of the tongue.

18. A railway tongue switch assembly for use in pavement comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the thickness of the railheads being at least $3\frac{3}{4}$ inches.

19. A railway tongue switch assembly for use in pavement comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the body including a central vertical ground-engaging support beneath the tongue floor extending longitudinally from the point end to the tongue pivot to directly support the first rail segment and the traffic-carrying railheads in each extreme position of the tongue.

20. A railway tongue switch assembly for use in pavement comprising a cast body having a heel end, a point end, a first rail segment at the point end, second and third rail segments at the heel end and a tongue floor; and a switch tongue pivotally mounted on the tongue floor for sliding movement between extreme traffic-carrying positions, characterized by the switch tongue having a first full-width railhead aligned with the first and second rail segments in one traffic-carrying position and a second full-width railhead aligned with the first and third rail segments in the other traffic-carrying position; and by the means pivotally mounting the tongue on the tongue floor comprising a circular recess in the floor extending into the body near the heel end, a circular hub extending downwardly from the tongue into the recess, longitudinally oriented diametrically opposed slots in the hub, mating slots in the body, a bar extending through the slots, and means removably mounting both ends of the bar in the body, the size of the hub slots relative to the bar being sufficient to permit limited rotation of the tongue between extreme positions, while preventing vertical displacement of the tongue.

21. The railway tongue switch assembly of claim 20, further characterized by a body-mounted stop adjacent one of the body slots engageable by one end of the bar, a body abutment longitudinally spaced from the other end of the bar and having an opening through which the bar can pass, and a locking block interposed between the bar other end and said abutment to lock the bar in the slots, the block being removable to permit the bar to be slid through the opening for removal from the slots to enable removal of the hub from the recess and consequent separation of the tongue from the body.

* * * * *